US006662500B2

(12) United States Patent
Inage

(10) Patent No.: US 6,662,500 B2
(45) Date of Patent: Dec. 16, 2003

(54) TRAIN DOOR APPARATUS

(75) Inventor: Akio Inage, Mie (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 10/155,243

(22) Filed: May 28, 2002

(65) Prior Publication Data

US 2003/0126797 A1 Jul. 10, 2003

(30) Foreign Application Priority Data

May 31, 2001 (JP) ..... 2001-164383

(51) Int. Cl.[7] ..... E05C 7/06
(52) U.S. Cl. ..... 49/116
(58) Field of Search ..... 49/116, 118, 139, 49/140, 360; 70/142, 143, 99, 100

(56) References Cited

U.S. PATENT DOCUMENTS 1,976,223 A 10/1934 Hedley et al.
5,755,060 A 5/1998 Zweili
5,927,015 A 7/1999 Ghosn et al.
6,134,838 A * 10/2000 Reddy ..... 49/362
6,278,376 B1 * 8/2001 Calamatas ..... 340/686.1
6,446,389 B1 * 9/2002 Heffner et al. ..... 49/280

* cited by examiner

*Primary Examiner*—Jerry Redman
(74) *Attorney, Agent, or Firm*—Kanesaka & Takeuchi

(57) ABSTRACT

A door apparatus for opening and closing two doors supported on a horizontal door rail includes an actuator connected to one of the two doors for driving the same, a direction conversion mechanism connected to the other of the two doors for transmitting a movement of the actuator to the other door to move the same and having an engaging portion formed of a first stage and a second stage, and a locking mechanism having a latch engaging the direction conversion mechanism for locking the two doors and non-engaging the direction conversion mechanism for allowing the two doors to open. The latch engages the first stage of the engaging portion to semi-lock the doors to be able to open manually, and engages the second stage of the engaging portion to lock the doors completely.

6 Claims, 7 Drawing Sheets

TRAIN DOOR APPARATUS

BACKGROUND OF THE INVENTION AND RELATED ART STATEMENT

The present invention relates to a door apparatus for opening and closing side doors of a train.

A mechanism for opening and closing a door of a train is an essential part for the safety of passengers on the train. Once the door of the train is closed, the door should not be opened accidentally regardless of moving or stationary. Further, the doors must always be held closed with a specific force to prevent rain or wind from entering, and to suppress vibrations. However, when an emergency such as a power failure happens to stop the train and the passengers need to evacuate from the train, it must be possible for a passenger to manually open the door relatively easily. Thus, a train door apparatus must be able to work very reliably. The inventor has already developed a train door apparatus that meets these requirements and applied for a patent (see Japanese Patent Publication (KOKAI) No. 2000-142392).

FIGS. 14 to 17 show a train door apparatus according to Japanese Patent Publication (KOKAI) No. 2000-142392. This apparatus is briefly described below. FIG. 14 is a front view showing an entire train door apparatus. FIG. 15 is an enlarged view of an essential part of the train door apparatus. In FIGS. 14 and 15, two doors 1 and 2 are movably suspended from and supported by a door rail 3 horizontally mounted along a side of a train. The two doors move in opposite directions (left and right in the figure) to open or close the train doorways. The door 1, shown at left in the figure, is driven by a linear motor 5 as an actuator connected to a moving member 4 of the door 1.

As shown in FIG. 15, a moving unit 5*a* of the linear motor 5 engages the moving member 4 to be able to slide for a predetermined distance 'x' in an opening or closing direction (to the right or left in the figure). A compression spring 6 is interposed between the moving unit 5*a* and the moving member 4, as shown in the figure. Thus, the linear motor 5 is connected to the door 1 so that the door can move by the distance 'x' in the opening direction thereof.

The right door 2 moves in cooperation with the door 1 via a direction conversion mechanism 7. As shown in FIG. 15, the direction conversion mechanism 7 is composed of a lower rack 9 connected to the moving member 4 of the door 1 via a connection rod 8, an upper rack 11 connected to the moving member 4 of the door 2 via a connection plate 10, and a pinion 12 that simultaneously engages these racks 9 and 11. The lower rack 9 and the upper rack 11 are guided to be able to slide within a unit case 7*a* fixed to the train in the opening or closing direction, and the pinion 12 is supported by a shaft fixed to the unit case 7*a*. The opening or closing movement of the door 1 driven by the linear motor 5 is transferred to the door 2 by changing the direction by the direction conversion mechanism 7.

FIGS. 16 and 17 are detailed views showing a locking mechanism 13 (in FIG. 14) attached to the direction conversion mechanism 7 and pushing/pulling attachments (members) 14 and 15 for locking and unlocking the locking mechanism 13. FIG. 16 shows a locked state, while FIG. 17 shows an unlocked state. In FIGS. 16 and 17, the pushing attachment 14 and the pulling attachment 15 are attached to a tip of the moving unit of the actuator 5.

The pushing attachment 14 has a rod-like shape and one end horizontally fixed to the actuator 5. The pulling attachment 15 with a key-shaped tip is placed on a top surface of the pushing attachment 14, and has one end joined to the actuator 5 by a pin to rotate and move along the vertical axis. The pulling attachment 15 is urged upward by a compression spring 16 interposed between the pulling attachment 15 and the pushing attachment 14. A pin 17 with a head is screwed into the pulling attachment 15 while loosely passing through the pushing attachment 14, and limits an upward rotational range of the pulling attachment. A guide fixture 18 contacts a top surface of the pulling attachment 15 and is attached to a tip of a fixed portion of the linear motor 5 to stop the pulling attachment from rotating upwardly.

The locking mechanism 13 has a slider 19 guided to be able to slide in the directions in which the doors 1 and 2 move; a back spring 20 composed of a compression spring to urge the slider 19 toward the door 2; a latch 21 guided to be able to slide vertically; and a locking spring 22 composed of a tension spring to urge the latch 21 downward. The slider 19 has a cam surface 19*a* disposed on a top surface thereof having an oblique stage surface, and an engaging protruding portion 19*b* provided at a tip thereof. Although not shown in detail, the latch 21 is composed of a vertical latch rod 24 guided to be able to move up or down inside a guide cylinder 23 fixed to a unit case 7*a*, and a frame 25 integrated with the latch rod 24. A roller 26 is rotatably attached to the frame 25 to contact the cam surface 19*a* of the slider 19. The locking spring 22 for urging the latch 21 downward is provided between the frame 25 and the unit case 6*a*. As described later, the latch 21 advances or retracts in concert with the opening and closing operations of the doors.

In the door apparatus described above, FIG. 16 shows a state in which the doors 1 and 2 are closed and locked. In this state, a tip of the latch rod 24 advances into an engaging hole 27 in the upper rack 11, which constitutes an engaging portion of the direction conversion mechanism 7, thereby locking the sliding motion of the upper rack 11. Thus, the doors 1 and 2, linked to the upper rack 11, will not move.

In this state, the pushing attachment 14 abuts against the engaging protruding portion 19*b* of the slider 19, and the key-shaped portion of the pulling attachment 15 engages the engaging protruding portion 19*b*. When a signal is sent to open the door, the moving unit 5*a* of the linear motor 5 moves to the left. With the door 1 staying at its closed position, the moving unit 5*a* initially moves to the left by a predetermined distance 'x' while pushing the compression spring 6. The pulling attachment 15 pulls the slider 19 via the engaging protruding portion 19*b*. At this time, the pulling attachment 15 tries to move upwardly, but it can not open, as it is pressed by the guide attachment 18.

When the slider 19 is pulled and moved to the left, the roller 26 is pushed onto an upper surface of the cam surface 19*a* via the inclined surface thereof as shown in FIG. 17. Thus, the latch 21 is lifted to withdraw the latch rod 24 from the engaging hole 27 to unlock the upper rack 11, thereby unlocking the doors 1 and 2. Once the moving unit 5*a* moves by the distance 'x', the guide attachment 18 stops pushing the pulling attachment 15. As a result, the pulling attachment 15 rotates upward by the compression spring 16 and is released from the engaging protruding portion 19*b* of the slider 19. Although the pulling attachment 15 is released, the slider 19 remains at its forward position due to a spring force of the back spring 20, thereby keeping the roller 26 pushed up.

Subsequently, the moving unit 5*a* moves the door 1 leftward to its predetermined open position. Correspondingly, the door 2 linked to the door 1 via the direction conversion mechanism 7 moves to the right to open the doors 1 and 2. Thereafter, a signal is sent to move the door 1 to the right, and the door 1 moves to its closed position, shown in FIG. 16. Then, the moving unit 5*a* pushes the slider 19 via the pushing attachment 14. As a result, the roller 26 falls from the upper surface of the cam surface 19*a*, and the latch rod 24 advances through the engaging hole 27 in the upper rack 11 to lock the doors again. When the doors need to be opened in an emergency, a handle 28, shown in FIG. 14, is rotated by 90 degree to pull up the latch 21 via a wire 29, thereby forcibly unlocking the doors.

In a state where the doors are closed, and the latch is engaged to lock the doors, if a hand or a cloth of a passenger is caught between the doors, the locked doors can not be manually opened. Thus, there is a safety problem associated with the train door apparatus described above.

It is thus an object of the present invention to improve the safety of a train door apparatus in an emergency when the train door apparatus has locked the door while in a closed state.

Further objects and advantages will be apparent from the following description of the invention.

SUMMARY OF THE INVENTION

To attain the above objects, the present invention provides a door apparatus. The door apparatus keeps a door in a semi-locked state rather than a fully locked state, even when the doors are closed, so that the door can be opened manually in a certain extent for a while after the train has left a station. For this purpose, in the present invention, a direction conversion mechanism transmits a movement of one door driven by an actuator to the other door in a converted direction. The direction conversion mechanism has a two-stage engagement portion with a latch. When the latch moves down to the first stage of the engagement portion, the doors become in a semi-locked state so that the door can be opened manually in a predetermined distance. When the latch moves further down to the second stage of the engagement portion, the door is completely locked. A stopper mechanism is provided to stop the latch during the operation. When the door is closed, the stopper mechanism stops the latch at the first stage of the engaging portion. Then, when the train reaches a specified speed or higher, the latch is released and moves through the engaging portion down to the second stage.

As a way for moving the latch in connection with the opening and closing operations of the doors, the actuator is connected to one of the doors to be able to move to open the door in a predetermined distance, as shown in Japanese Patent Application (KOKAI) No. 2000-142392. The apparatus is provided with the slider supported to be able to slide in a door moving direction and having a stage cam surface on a top surface; a back spring for urging the slider toward one of the doors; a roller connected to the latch and contacting the cam surface of the slider; a locking spring for urging the latch toward an engaging portion of the direction conversion mechanism; and pushing/pulling attachments (members) attached to the actuator.

When the doors are closed, the actuator pushes the slider via the pushing attachment. The roller is pushed down from an upper stage of the cam surface by the locking spring, and the latch advances into the engaging portion, thereby locking the doors in a closed state. When the doors are opened, the actuator moves in the predetermined distance in the opening direction to pull the slider via the pulling attachment. The roller is pushed onto the upper stage of the cam surface, thereby withdrawing the latch from the engaging portion to unlock the door.

As another means for moving the latch in connection with the opening and closing operations of the doors, the apparatus may be provided with a locking spring for urging the latch toward the engaging portion of the direction conversion mechanism and a solenoid for driving the latch against a force of the locking spring. In this case, to close the doors, the latch is moved into the engaging portion by the locking spring to lock the doors, whereas to open the doors, the solenoid moves the latch from the engaging portion to unlock the doors.

As yet another means for moving the latch in connection with the opening and closing operations of the doors, the apparatus may be provided with a solenoid for driving the latch to advance into the engaging portion of the direction conversion mechanism or retracts therefrom. In this case, to close the doors, the solenoid moves the latch to enter into the engaging portion to lock the doors, whereas to open the doors, the solenoid moves the latch to withdraw from the engaging portion to unlock the doors.

The stopper mechanism is constituted of a slide piece for abutting against the latch when the latch advances into the engaging hole and a solenoid for moving the slide piece into or out in a latch moving path.

DETAILED DESCRIPTION OF PREFERRED EMBODIMENTS

Hereunder, preferred embodiments of the present invention will be explained with reference to the accompanied drawings. In these figures, the same reference numbers denote the parts corresponding to those in the prior art (FIGS. 14 to 17).

Figure 1:
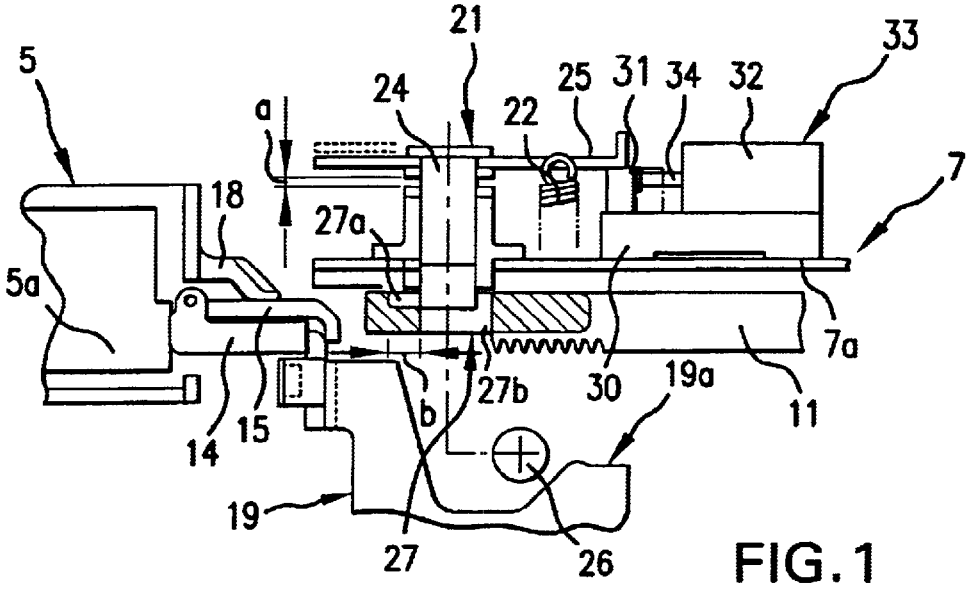
FIG. 1 is a front view showing an essential part of a train door apparatus in a semi-locked state, according to an embodiment of the present invention.
Figure 2:
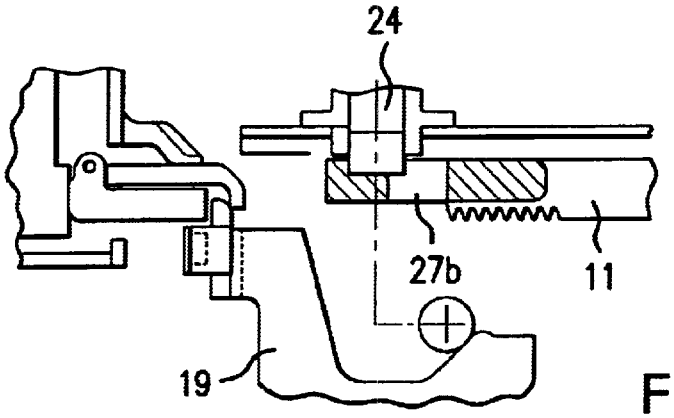
FIG. 2 is a front view showing an essential part of the door apparatus in FIG. 1 in a state where the doors are manually opened.
Figure 3:
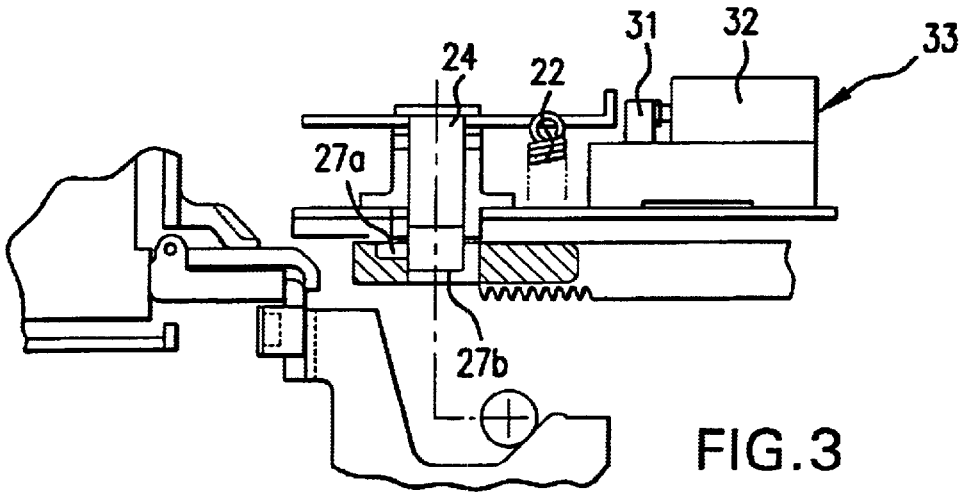
FIG. 3 is a front view showing an essential part of the door apparatus in FIG. 1 in a fully locked state.
Figure 4:
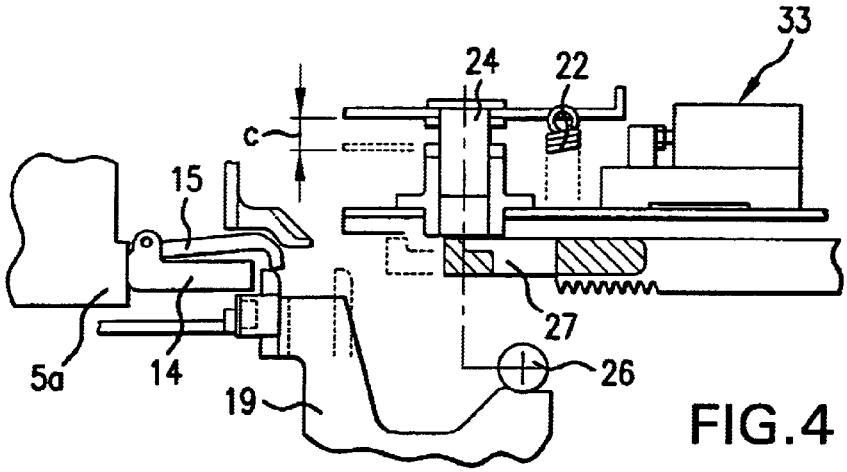
FIG. 4 is a front view showing an unlocking operation of the door apparatus in FIG. 1.
Figure 5:
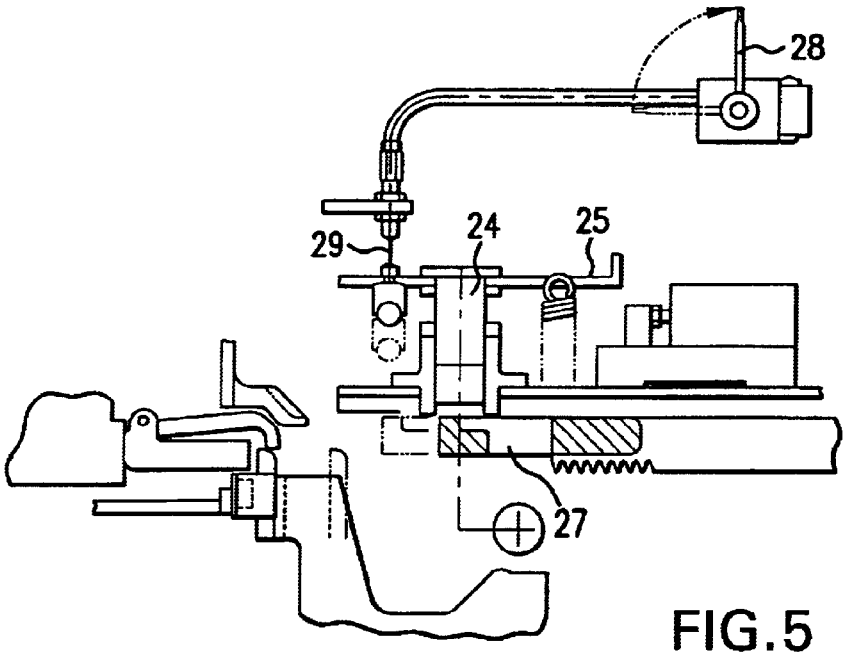
FIG. 5 is a front view showing an emergency opening operation of the door apparatus in FIG. 1.
Figure 16:
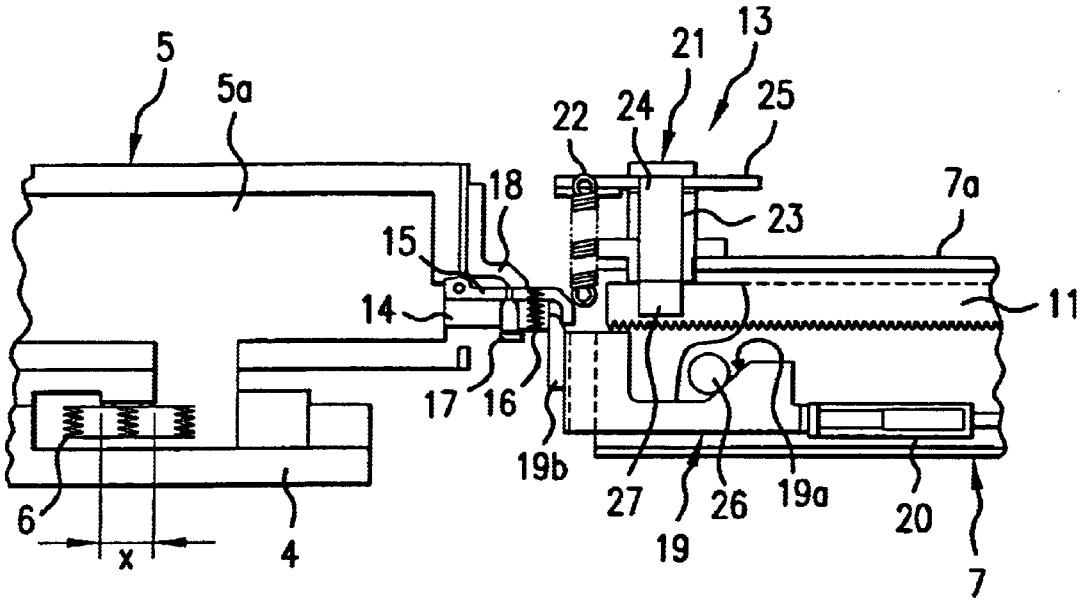
FIG.16 PRIOR ART
FIG. 16 is a front view showing a locking operation of the door apparatus in FIG. 14.
Figure 17:
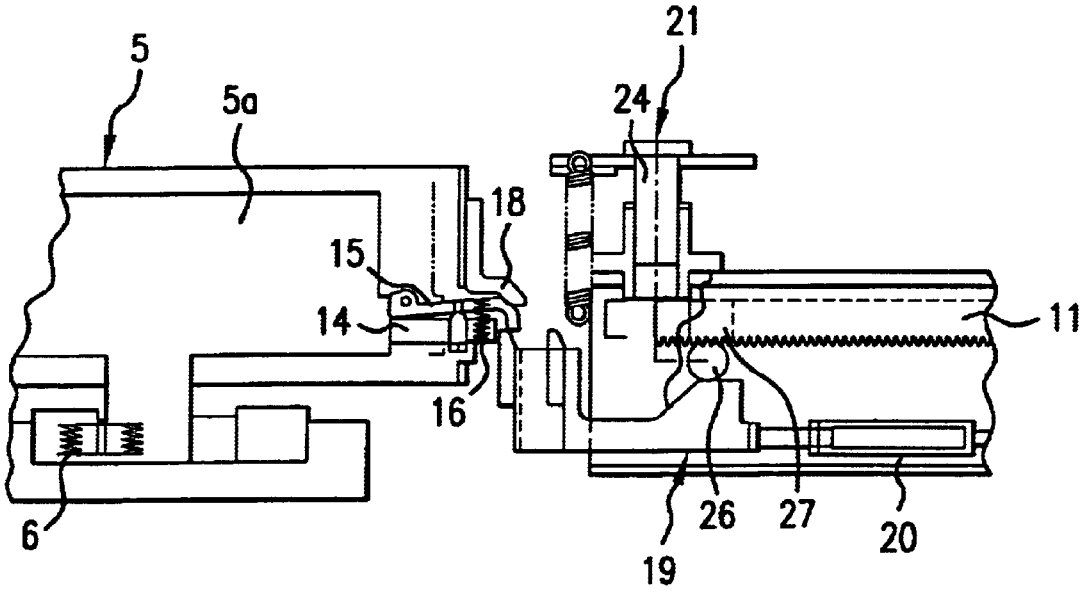
FIG.17 PRIOR ART
FIG. 17 is a front view showing an unlocking operation of, the door apparatus in FIG. 14.

First, FIGS. 1 to 5 show the first embodiment in which the present invention has been applied to the conventional apparatus of FIG. 16. FIGS. 1 to 5 is partially sectional front views of a locking mechanism portion (the compression spring 16 and the pin with a head 17 shown in FIG. 16 are omitted). FIG. 1 shows a semi-locked state, FIG. 2 shows a state in which the doors in FIG. 1 are manually opened in a specified distance, FIG. 3 shows a fully locked state, FIG. 4 is an unlocked state, and FIG. 5 shows an emergency unlocked state.

A difference in FIG. 1 from the prior art is that the engaging hole 27, that engages the latch rod 24 of the direction conversion mechanism 7, is formed of two stages. The latch rod 24 has an elliptical cross-section, with a larger diameter in the transverse direction in FIG. 1. The engaging hole 27 engages the latch rod 24 with an appropriate gap, and has a semi-elliptical recess along an outer peripheral surface of the latch rod 24 formed at an upper left of the elliptical through-hole, shown in FIG. 1. The engaging hole 27 is formed of two stages, namely the first stage 27*a* and the second stage 27*b*.

A unit case 7*a* of the direction conversion mechanism 7 has a stopper mechanism 33 installed thereon. The stopper mechanism 33 is composed of a block-shaped slide piece 31 guided by a slide base 30 to be able to slide in the transverse direction of FIG. 1 and a solenoid 32 for moving the slide piece 31. The solenoid 32 is composed of a bi-stable polarized electric magnet containing a permanent magnet to generate a stroke in the transverse direction of FIG. 1. Whenever a switch signal is input, a plunger 34 is reversed and held at the end of the stroke by the permanent magnet. The slide piece 31 slides in and out from a moving path of the latch 21 (the vertical direction in FIG. 1). When the slide piece 31 slides in the path, the slide piece 31 abuts against the frame 25 to stop the latch 21 (the frame 25) in the middle of advancement, as shown in FIG. 1. The locking spring 22 is installed on the frame 25 between the latch rod 24 and the stopper mechanism 33. The other configurations are substantially the same as those of the conventional apparatus in FIG. 16.

In the door apparatus according to this embodiment, when the actuator 5 drives the doors (see FIG. 5) into the closed position upon a close instruction from a vehicle, the roller 26 falls from the cam surface 19*a*, and the latch rod 24 is pulled toward the engaging hole 27 by the spring force of the locking spring 22. When the close instruction is sent, the stopper mechanism 33 has already moved the slide piece 31 into the moving path of the latch 21. As shown in FIG. 1, the latch 21 is stopped at a distance 'a' from the fully locked position, with the frame. 25 abutting against the slide piece 31 and pressed by the locking spring 22. At this time, the tip of the latch rod 24 has already entered the engaging hole 27 down to the first stage 27*a*, as shown in FIG. 1 (a semi-locked state). The actuator 5 has an encoder for detecting a position of the moving unit 5*a*, so that a thrust of the moving unit 5*a* can be reduced to, for example, about one-tenths of its normal value before the doors are completely closed.

In the semi-locked state, the doors are pushed in the closing direction with this small force. In this state, the doors can be opened with a hand. When the doors are pushed, the doors open with the upper rack 11 moving to the right in FIG. 1. The doors are then locked when the latch rod 24 engages the first stage 27*a* of the engaging hole 27. FIG. 2 shows the state where the door can be opened manually. The distance 'b' (FIG. 1) in which the upper rack 11 can move may be set, for example, to be 15 to 20 mm. This setting allows the doors to be opened by a double distance (b×2), for example, 30 to 40 mm. Accordingly, when a cloth or a hand of a passenger is caught between the doors, the passenger can pull it free from the doors by pushing the doors.

The semi-locked state in FIG. 1 is maintained while the train is not moving or is moving within a low-speed range, for example, 5 km/hour, after starting. Once the train reaches a specific speed, a switch signal based on a speed signal from the vehicle is sent to the solenoid 32. The solenoid 32 is reversed to retract the slide piece 31, i.e. move to the right in FIG. 1. As a result, the latch 21 is released from the slide piece 31 and further moved down by the spring force of the locking spring 22. The latch rod 24 moves in the engaging hole 27 from the first stage 27*a* to the second stage 27*b*, thereby bringing the apparatus into the state shown in FIG. 3 (the fully locked state). In the fully locked state, the upper rack 11 is fully locked by engaging the latch rod 24, thereby fully locking the doors.

FIG. 4 shows a state where the train has stopped and the doors start to open from the closed state as shown in FIG. 3. When the doors open, the moving unit 5*a* of the actuator 5 moves by the specific distance 'x' (see FIG. 17) with the doors closed state, while the pulling attachment 15 pulls the slider 19 to push the roller 26 onto the cam surface 19*a*, as described in the prior art. The latch rod 24, integrated with the roller 26 via the frame 25, is pushed upward by a distance 'c' to push from the engaging hole 27 to unlock the doors as shown in FIG. 4. Then, the actuator 5 opens the doors. Once the moving unit 5*a* of the actuator 5 reaches its fully opened position, the above-described encoder sends a fully opened signal, which is then transmitted to the solenoid 32. The solenoid 32 is reversed from the state shown in FIG. 3 to move the slide piece 31 to a position corresponding to the state shown in FIG. 1 to be ready for the next operation.

FIG. 5 shows an emergency unlocking operation. In the fully locked state in FIG. 3, the handle 28 is rotated from a position shown by a broken line in FIG. 5 to a position shown by a solid line in FIG. 5 to pull up the frame 25 via the unlocking cable 29. This causes the latch rod 24 to withdraw from the engaging hole 27 to allow the doors to be fully opened manually.

Figure 6:
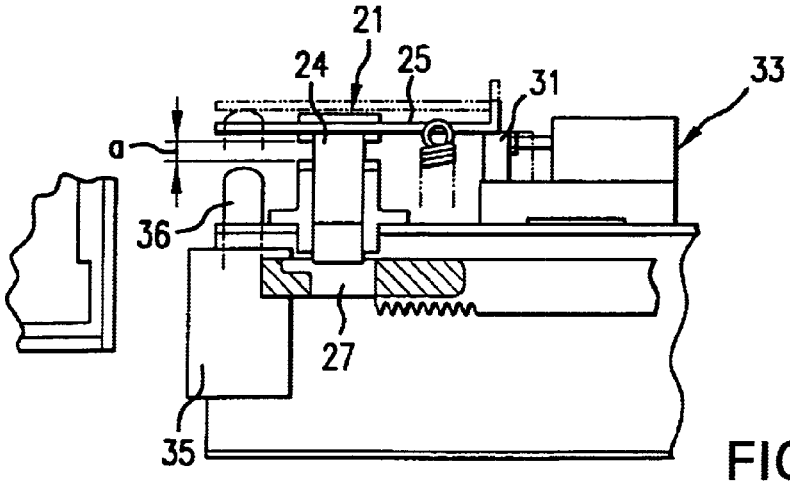
FIG. 6 is a front view showing an essential part of a train door apparatus in a semi-locked state according to the second embodiment of the present invention.
Figure 7:
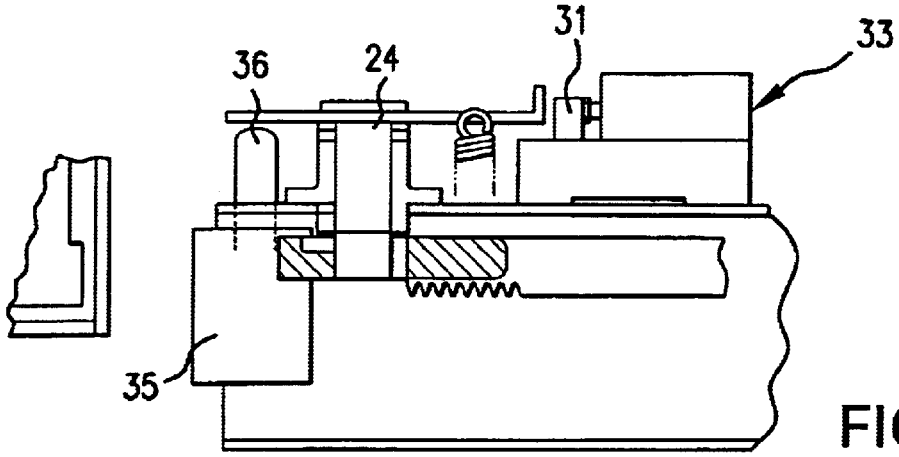
FIG. 7 is a front view showing the door apparatus in FIG. 6 in a fully locked state.
Figure 8:
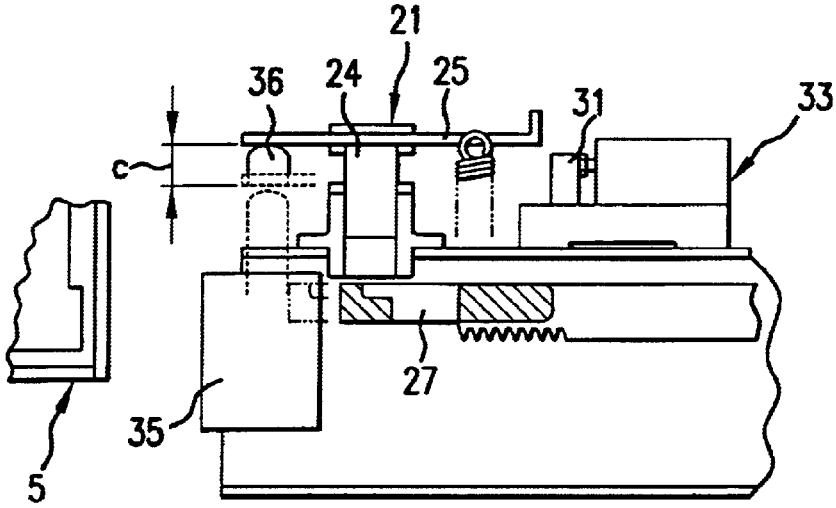
FIG. 8 is a front view showing an unlocking operation of the door apparatus in FIG. 6.
Figure 9:
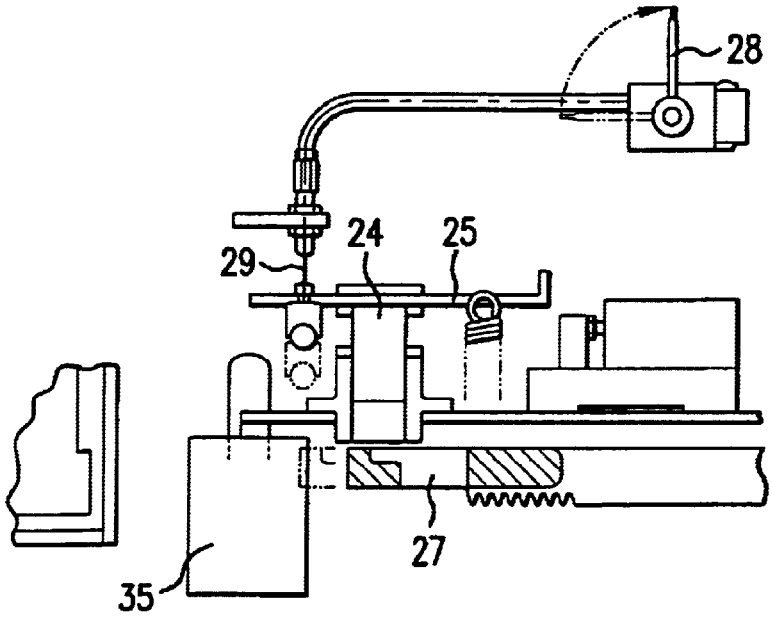
FIG. 9 is a front view showing an emergency opening operation of the door apparatus in FIG. 6.

FIGS. 6 to 9 shows the second embodiment using a solenoid as an unlocking device. FIG. 6 shows a semi-locked state, FIG. 7 shows a fully locked state, FIG. 8 shows an unlocked state, and FIG. 9 shows an emergency unlocking operation. In this embodiment, a solenoid 35 is installed opposite to the frame 25 of the latch 21 instead of the slider 19, the roller 26, the pushing attachment 14, the pulling attachment 15, and other parts in the embodiment shown in FIG. 1. The solenoid 35 is also composed of a bi-stable polarized electromagnet so that a plunger 36 moves in the vertical direction of FIG. 6 and is held at the end of the stroke by a permanent magnet.

In the fully locked state of FIG. 7, the plunger 36 of the solenoid 35 is at a retracted position. Upon an open instruction, the plunger 36 pushes up the frame 25 of the latch 21. As shown in FIG. 8, the latch rod 24 is withdrawn from the engaging hole 27 to unlock the doors. Then, the actuator 5 opens the doors. Once the doors are fully opened, with a fully open signal from the encoder, the stopper 33 is driven to move the slide piece 31 into the moving path of the latch 21. Subsequently, when a close instruction is sent to close the doors, with a fully close signal from the encoder, the solenoid 35 is switched to move the plunger 36 to retract. Thus, the latch 21 is lowered by the spring force of the locking spring 22, abuts against the slide piece 31, and is stopped, thereby bringing the apparatus into the semi-locked state shown in FIG. 6. The other parts of the construction and operation are the same as those in the embodiment shown in FIGS. 1 to 5, and the description is thus omitted.

Figure 10:
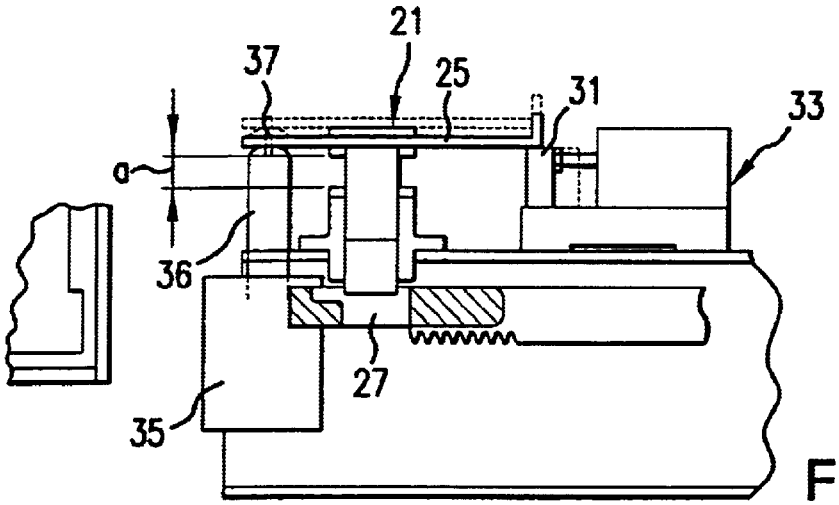
FIG. 10 is a front view showing an essential part of a train door apparatus in a semi-locked state, according to the third embodiment of the present invention.
Figure 11:
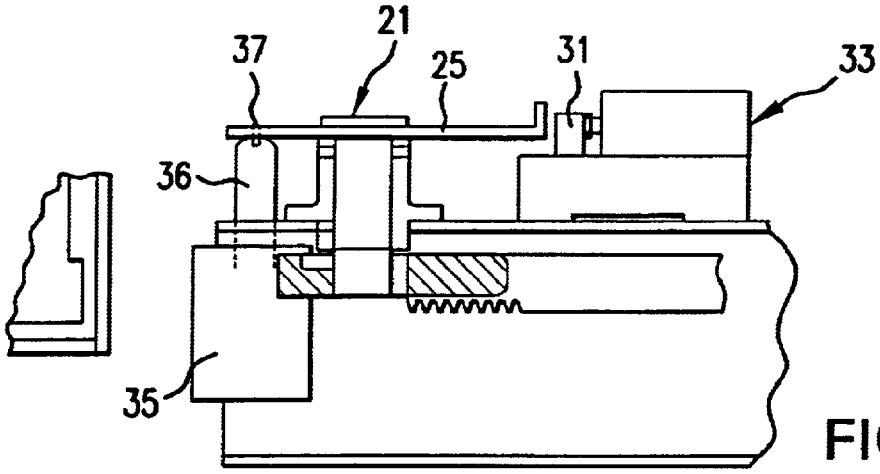
FIG. 11 is a front view showing the door apparatus in FIG. 10 in a fully locked state.
Figure 12:
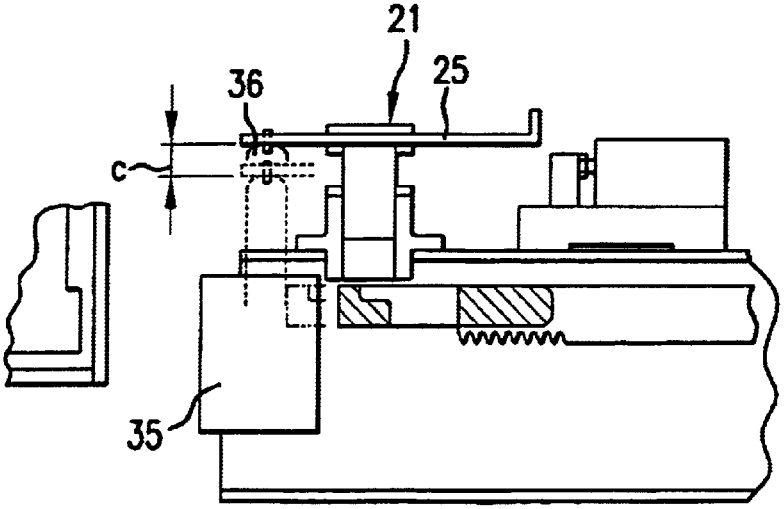
FIG. 12 is a front view showing an unlocking operation of the door apparatus in FIG. 10.
Figure 13:
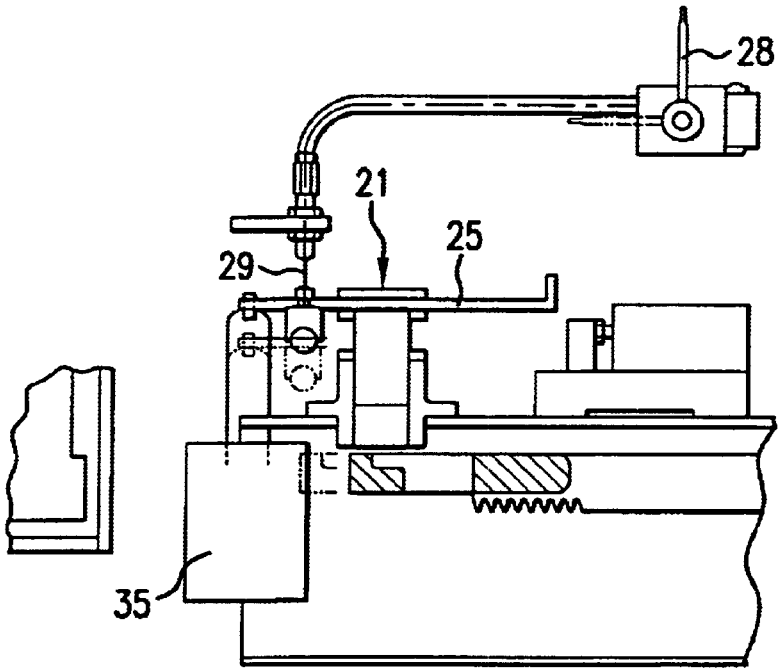
FIG. 13 is a front view showing an emergency opening operation of the door apparatus in FIG. 10.
Figure 14:
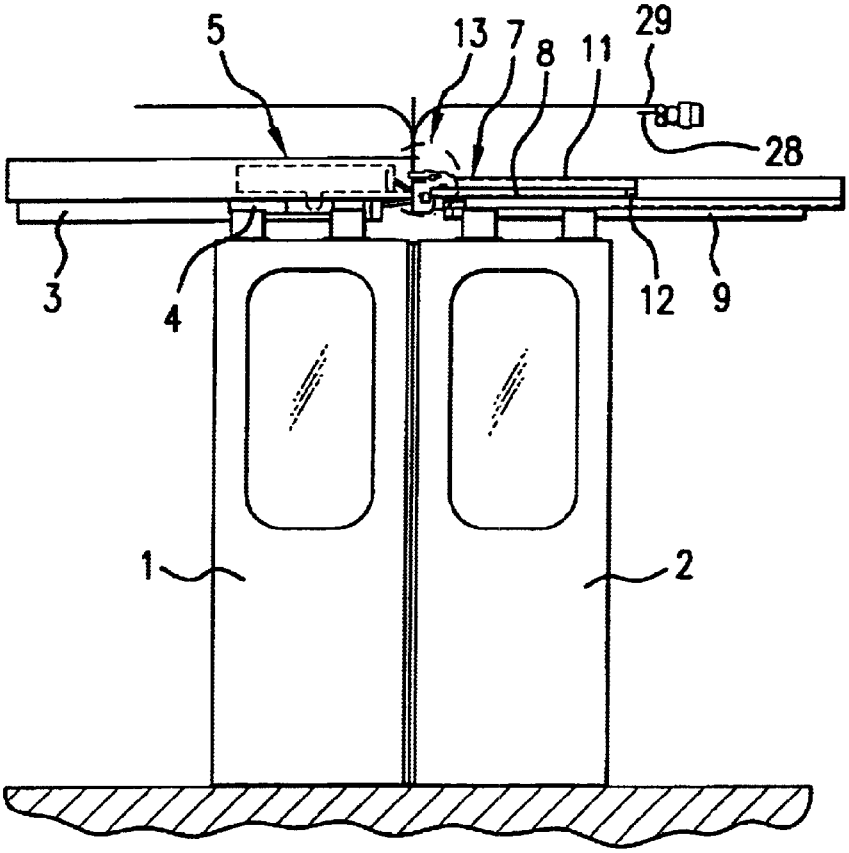
FIG. 14 PRIOR ART
FIG. 14 is a front view showing an entire construction of a conventional door apparatus.
Figure 15:
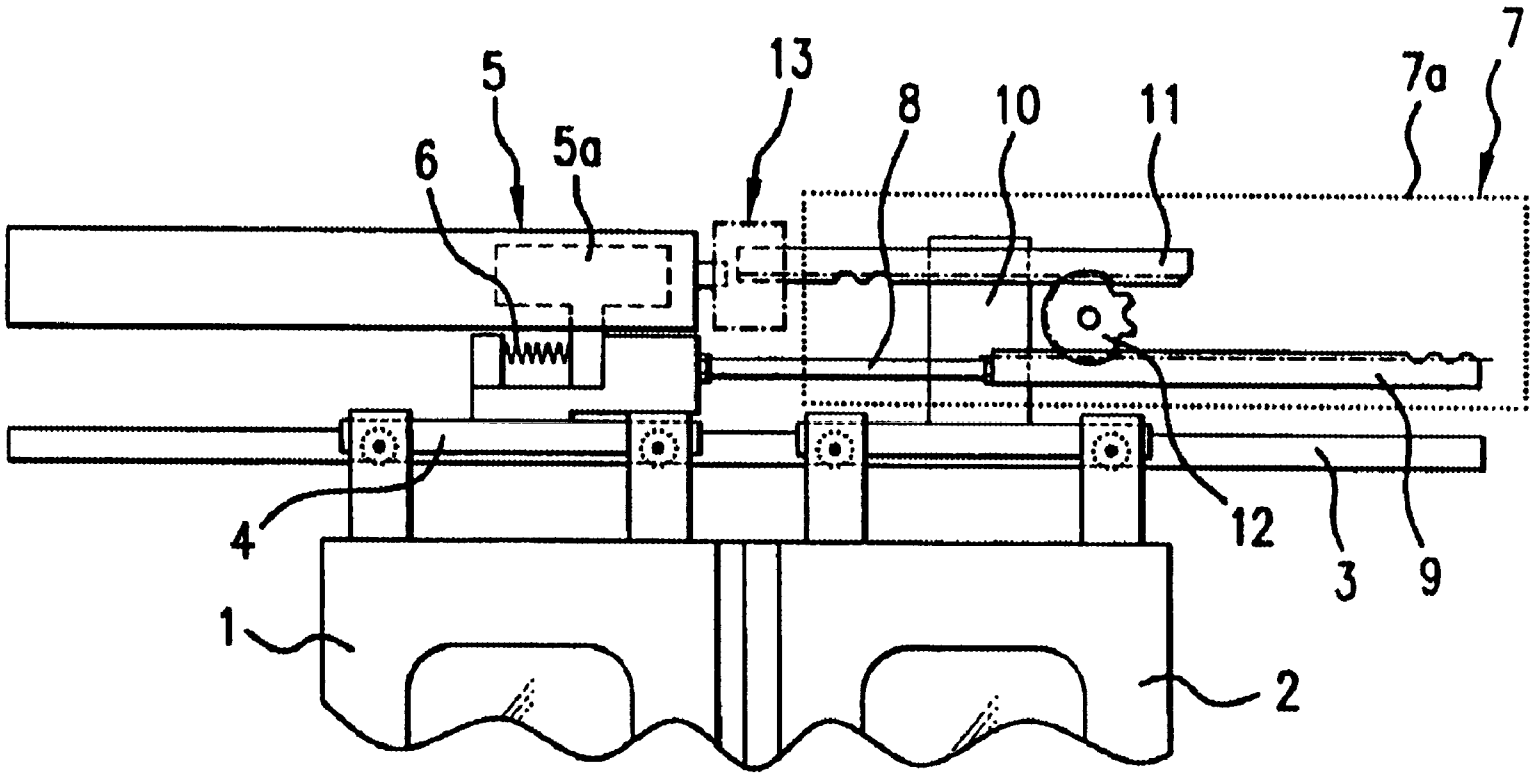
FIG. 15 PRIOR ART
FIG. 15 is an enlarged view showing an essential part of the door apparatus in FIG. 14.

FIGS. 10 to 13 shows the third embodiment. FIG. 10 shows a semi-locked state, FIG. 11 shows a fully locked state, FIG. 12 shows an unlocked state, and FIG. 13 shows an emergency unlocked state. In this embodiment, the locking spring in the second embodiment is omitted. As shown in FIG. 10, the plunger 36 of the solenoid 35 is connected to the frame 25 of the latch 21 via a joining attachment 37. When the doors are closed, the plunger 36 of the solenoid 35 retracts to pull down the latch 21 to move the latch rod 27 through the engaging hole 27. Accordingly, the locking spring 22 is not required. Other aspects of the configuration and operation are the same as those in the second embodiment, and the description is thus omitted.

As described above, according to the present invention, the semi-locked state is maintained for some time after the train has left from the station. Accordingly, the door safety function is added to the apparatus in addition to the conventional closing function so that a cloth or a hand of the passenger caught between the doors can be easily released therefrom, thereby improving the passenger safety.

While the invention has been explained with reference to the specific embodiments of the invention, the explanation is illustrative and the invention is limited only by the appended claims.

What is claimed is:

1. A door apparatus for opening and closing two doors supported on a horizontal door rail, comprising, an actuator connected to one of the two doors for driving the one door, a direction conversion mechanism connected to the other of the two doors for transmitting a movement of the one door to the other door to move the other door in a direction opposite to the movement of the one door, said direction conversion mechanism having a first stage engaging portion and a second stage engaging portion smaller in size than the first stage engaging portion and situated adjacent to the first stage engaging portion, a locking mechanism having a latch engaging the direction conversion mechanism for locking the two doors and non-engaging the direction conversion mechanism for allowing the two doors to open, said latch being located in the first stage engaging portion to semi-lock the doors to be able to open manually and in the second stage engaging portion to lock the doors completely, and a stopper mechanism cooperating with the direction conversion mechanism for locating the latch at the first stage engaging portion, said stopper mechanism releasing the latch located in the first stage engaging portion to allow the latch to enter the second stage engaging portion when a predetermined condition is satisfied.

2. A door apparatus according to claim 1, further comprising a slider disposed adjacent to the direction conversion mechanism and including a cam having an upper stage surface and a lower stage surface; a back spring attached to the slider for urging the slider toward the one door; a roller connected to the latch and contacting the cam of the slider; a locking spring attached to the latch for urging the latch toward the engaging portion of the direction conversion mechanism; and pushing/pulling members attached to the actuator, said pushing/pulling member, when the pushing/pulling member is pushed by the actuator to close the doors, pushing the roller to the lower stage surface of the cam from the upper stage surface to move the latch to the engaging portion by a force of the locking spring, and when the pushing/pulling member is pulled by the actuator to open the doors, pushing the roller onto the upper stage surface of the cam to disengage the latch from the engaging portion.

3. A door apparatus according to claim 2, wherein said actuator is attached to the one door to allow the actuator to move relatively for a predetermined distance in an opening direction.

4. A door apparatus according to claim 1, further comprising a locking spring for urging the latch toward the first and second engaging portions of the direction conversion mechanism, and a solenoid for driving the latch against the locking spring, said solenoid, when the doors are to be closed, allowing the latch to enter the engaging portion by a force of the locking spring, and when the doors are to be opened, releasing the latch from the engaging portion of the direction conversion mechanism.

5. A door apparatus according to claim 1, further comprising a solenoid attached to the latch, said solenoid moving the latch to engage the first and second engaging portions of the direction conversion mechanism when the doors are closed, and to disengage therefrom when the doors are opened.

6. A door apparatus according to claim 1, wherein said stopper mechanism is formed of a slide piece for stopping the latch and a solenoid for driving the slide piece.

* * * * *

UNITED STATES PATENT AND TRADEMARK OFFICE

CERTIFICATE OF CORRECTION

PATENT NO. : 6,662,500 B2
DATED : December 16, 2003
INVENTOR(S) : Akio Inage

It is certified that error appears in the above-identified patent and that said Letters Patent is hereby corrected as shown below:

Column 4,
Line 67, delete comma after “of”; and

Column 5,
Line 58, delete period after “frame”.

Signed and Sealed this

Third Day of February, 2004

JON W. DUDAS
*Acting Director of the United States Patent and Trademark Office*